United States Patent [19]

Deklerow

[11] Patent Number: 4,655,404

[45] Date of Patent: Apr. 7, 1987

[54] FLUORESCENT LAMP CRUSHER

[76] Inventor: Joseph W. Deklerow, 37 Lynnhaven Ct., Rochester, N.Y. 14618

[21] Appl. No.: 312,350

[22] Filed: Oct. 16, 1981

[51] Int. Cl.[4] ..... B02L 19/14

[52] U.S. Cl. ..... 241/99; 241/DIG. 14

[58] Field of Search ..... 241/99, DIG. 14; 55/316, 372, 385, 472

[56] References Cited

U.S. PATENT DOCUMENTS

| | | | |
|---|---|---|---|
| 996,691 | 7/1911 | Wallace et al. | 55/372 |
| 1,356,061 | 10/1920 | Frank | 55/372 |
| 3,675,398 | 7/1972 | Giurrizzo | 55/316 |
| 3,755,989 | 9/1973 | Fornoff et al. | 55/72 |
| 3,913,849 | 10/1975 | Atanasoff et al. | 241/99 |
| 4,226,377 | 10/1980 | Shelton | 241/99 |

FOREIGN PATENT DOCUMENTS

| | | | |
|---|---|---|---|
| 804146 | 10/1936 | France | 55/372 |
| 63554 | 6/1941 | Norway | 55/372 |

*Primary Examiner*—Timothy V. Eley

*Attorney, Agent, or Firm*—Shlesinger, Fitzsimmons & Shlesinger

[57] ABSTRACT

The device comprises a cylindrical crusher housing mounted on a carriage above a removable wastebucket, which communicates with a funnel-shaped discharge formed in the lower end of the housing. The top of the housing is sealed by a cover which has a lamp inlet opening and an exhaust opening. The shaft of an electric motor extends into the housing and has secured thereto a plurality of flails or crusher elements which rotate at high speeds adjacent the inlet opening to strike and crush lamps entering the housing. The exhaust opening is connected by a duct to a filter cartridge which is removably mounted on the exterior of the crusher housing above an exhaust fan. The cartridge contains a porous filter bag, which is removably attached to the exhaust duct, and an activated charcoal filter element, which is positioned in the cartridge beneath the bag and in communication with the fan inlet. The exhaust fan operates simultaneously with the crusher motor to develop a vacuum which draws exhaust air from within the housing successively through the filter bag and the charcoal filter element. The filter element is specially treated to remove mercury vapor from the exhaust air that passes through the element.

11 Claims, 4 Drawing Figures

FLUORESCENT LAMP CRUSHER

BACKGROUND OF THE INVENTION

This invention relates to lamp crushers, and more particularly to an improved device for crushing fluorescent lamps of the type having tubular configurations. Even more specifically, this invention relates to an improved crusher of the type described which prevents discharge of toxic-mercury vapors during destruction of the lamps.

Typically fluorescent lamp crushers of the type presently available comprise, basically, a housing containing one or more rotating flails, a tube extending into the top of the housing for guiding fluorescent lamps downwardly into the path of the rotating flails, a container removably positioned beneath an opening in the bottom of the housing to collect the particles of glass produced by the crushed lamps, and a filter bag for collecting minute or tiny particles of glass which rise from an exhaust opening in the housing during operation of the flails.

During their manufacture, the inside surfaces of most conventional fluorescent lamp tubes are coated with a thin layer of phosphor crystals. The tubes are then evacuated, after which a small amount of liquid mercury is admitted to the interior of the tube. During operation of the lamp the mercury vaporizes, and in response to electrons generated by the tube cathodes tends to increase the whiteness of the illumination generated by the tube. Unfortunately, however, these mercury vapors are very toxic, and in the case of prior lamp crushers, have tended to leak from the crushing device into the adjacent atmosphere, thus creating an undesirable hazzard for the operator of the device.

Still another disadvantage of such prior crushers is the tendency of the crushed tube particles and gases to back up into the tube inlet, and discharging into the face of the operator.

SUMMARY OF THE INVENTION

It is an object of this invention, therefore, to provide an improved fluorescent lamp crusher which will eliminate, or reduce to harmless proportions, the amount of toxic gases released in the vicinity of a lamp crusher during its operation. To that end, the improved crusher made according to this invention employs a novel filter system, which includes an exhaust fan for generating a vacuum at the exhaust opening in the crusher housing, thereby to convey into a special filter any toxic gases, including mercury vapors, which may be released from the lamps as they are shattered. Also, the filter system of this invention utilizes a treated charcoal filter, which removes from the air flowing through the filter substantially all of the mercury vapors contained in the air exhausted from the crusher housing, so that the filter discharges substantially mercury-free air into the atmosphere adjacent the crusher.

The present invention also has for one of its purposes the use of improved flails in the crusher, and which as compared to prior such flails, tend to increase the efficiency with which the lamps are crushed or shattered upon entering the crusher housing. More specifically, the improved flails of this invention tend to grind the glass tubes more uniformly, and into finer particles, as compared to prior such flails, and also help to generate in the housing a pressure ambient which prevents any undesirable backup into the tube inlet.

THE DRAWINGS

DETAILED DESCRIPTION OF THE PREFERRED EMBODIMENT OF THIS INVENTION

Figure 1:
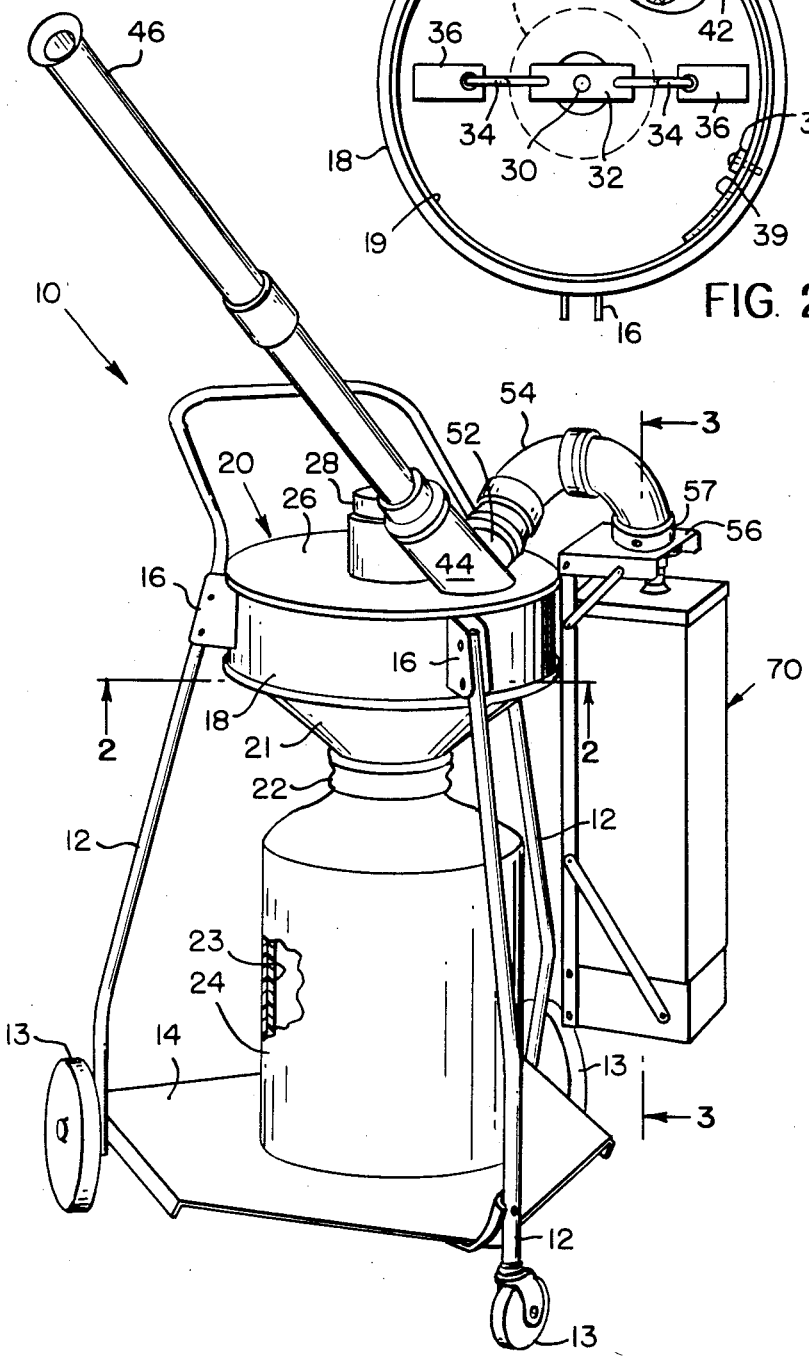
FIG. 1 is a perspective view of an improved fluorescent lamp crusher made according to one embodiment of this invention.

Referring now to the drawings by numerals of reference, 10 denotes generally a fluorescent lamp crusher of the portable variety, comprising three, generally vertically disposed legs 12, which are mounted at their lower ends on wheels 13, and which support between their lower ends a horizontally disposed shelf or waste bag supporting plate 14. At their upper ends the legs 12 are releasably secured to three brackets 16, which are fastened to the outer peripheral surface of the annular wall portion 18 of a steel crusher housing that is denoted generally in FIG. 1 by the numeral 20. Housing wall 18, which is lined with a layer 19 (FIG. 2) of rubber, or the like, is closed at its lower end by a funnel element 21, the lower, discharge end of which is surrounded by a resilient ring clamp 22.

Removably mounted on plate 14 beneath housing 20 is a cylindrically-shaped plastic container or bucket 23, the upper, open end of which registers with the opening in the funnel element 21. The bucket 23 is enclosed in a plastic bag 24, the open end of which is secured sealingly around the discharge end of funnel element 21 by the clamp 22.

Secured over the upper end of wall 18 coaxially thereof is a flat, circular cover plate 26. Mounted centrally on the outside of cover plate 26 is a conventional electric motor 28, which has a drive shaft or armature 30 (FIG. 2) that extends through a central opening in plate 26 coaxially into the center of wall 18. Bolted or otherwise secured intermediate its ends to the inner end of shaft 30 is a metal plate 32, opposite ends of which project radially beyond the peripheral surface of shaft 30. Releasably attached by hooks 34 to opposite ends of plate 32 are two, rectangularly-shaped bars or flails 36, which are disposed to be rotated in a transverse plane in the housing 20 when motor 28 is energized.

Secured at its lower end as by welding or the like in a generally oval-shaped inlet opening 42 (FIG. 2) in the cover 26 is a tubular support 44 (FIG. 1), the axis of which is inclined at approximately 45° to the horizontal. Secured to the upper end of the support 44 in communication with its bore is an elongate, tubular lamp feeder 46, which is designed to guide fluorescent lamps one by one downwardly through support 44 and inlet 42 into the path of the rotating striker bars 36. Adjustably secured by a bracket 38 (FIG. 2) to wall 18 to overlie a portion of its rubber liner 19 opposite inlet 42 is an arcuate, protective metal plate 39, which has been case hardened.

Secured in an opening formed in the annular wall of the tubular support 44 adjacent the point where it communicates with the opening 42 in cover 26 is one end of a tubular exhaust pipe 52. Housed in pipe 52 transversely of its bore is a screen 53, which prevents large particles of glass from being discharged through pipe 52. The upper end of pipe 52 is releasably connected to one end of a rigid exhaust duct 54, the opposite end of which curves downwardly and extends through a central opening in a filter supporting bracket 56.

Bracket 56, which is secured to duct 54 by a ring 57 (FIG. 3), has a pair of spaced, parallel side flanges 58 that are secured to the upper ends of a pair of elongate, vertically disposed straps 59. Secured to the lower ends of straps 59 is a fan housing 61 which has central openings 62 and 63 formed in the upper and lower ends therof, respectively. An axial exhaust fan 64 is mounted in the lower end of housing 61 coaxially of its openings 62 and 63, and with its motor 65 connected in a conventional manner with the crusher motor 28 for operation therewith.

Releasably mounted on top of the motor housing 61 to extend vertically between the housing and the lower, discharge end 54' (FIG. 3) of exhaust duct 54 is a novel filter cartridge denoted generally by numeral 70. This cartridge comprises a sleeve or casing 71, the lower end of which seats slidably as at 72 over the upper end of fan housing 61, and the upper end of which has therein a central opening 73 which fits slidably over the discharge end 54' of the exhaust duct. Secured at its upper end, as by glue or the like, to the inside of the cartridge casing 71 around the discharge end 54' of the exhaust duct is a porous filter bag 75, which may be made of paper, fabric, or some similar material. Bag 75 has a diameter smaller than the inside diameter or cross sectional area of casing 71, so that a space 76 exists between the bag and the inside wall of the cartridge casing.

Figure 3:
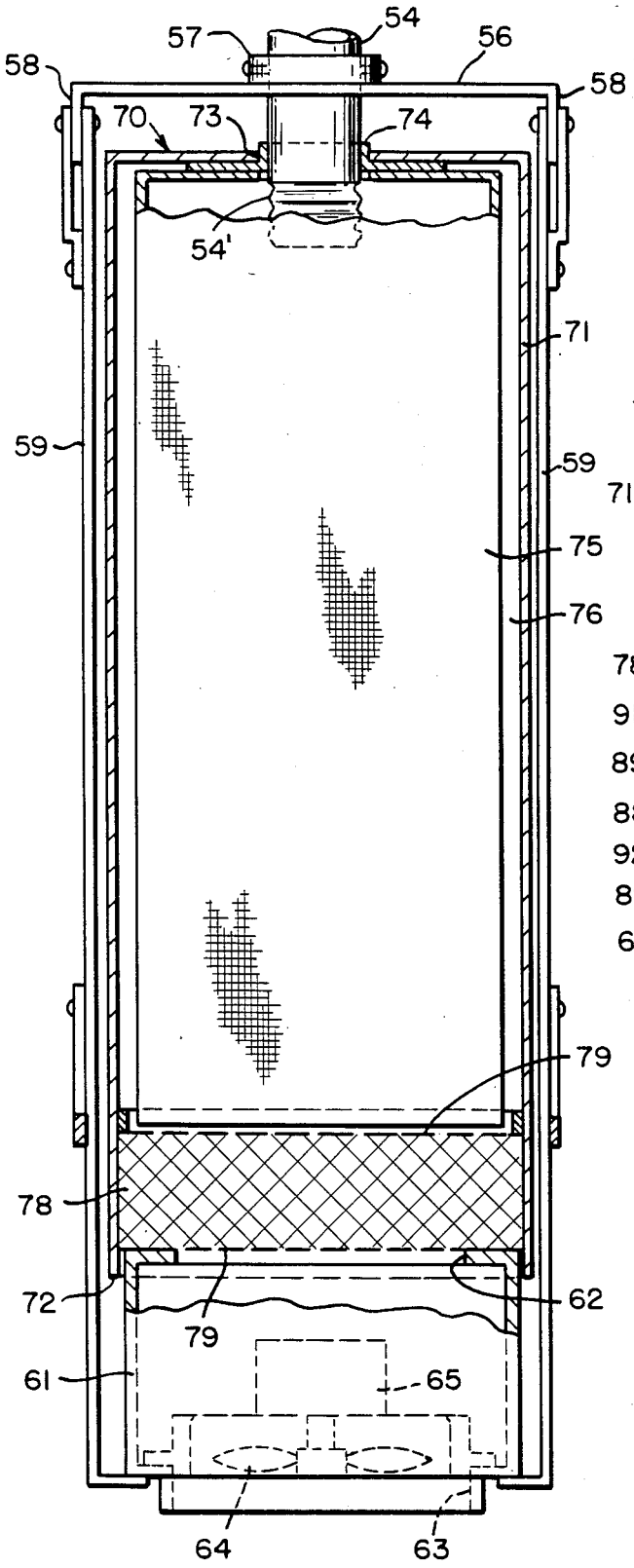
FIG. 3 is a fragmentary sectional view taken generally along the line 3—3 in FIG. 1 looking in the direction of the arrows.

Also as shown more clearly in FIG. 3, bag 75 is shorter in length than casing 71, and its lower, closed end overlies a relatively thick, activated charcoal filter element 78, which is secured in casing 71 adjacent its lower end between a pair of spaced screen member 79. The filter element 78 and its associated screen members 79 are secured in the cartridge casing 71 just above its lower end 72, thus leaving a slight recess in the lower end of the cartridge for accommodating the upper end of the fan housing 61.

Also as shown in FIG. 3, a resilient washer 74 is secured between casing 71 and the upper end of bag 75, and has a central opening slightly smaller than those in casing 71 and bag 75, so that the washer will sealingly surround the exhaust outlet 54'.

When the motor 28 is energized to commence rotation of the flails 36, the exhaust fan motor 65, which is connected in parallel with motor 28, is also energized, thereby creating a vacuum in the motor housing 61 above the fan 64. This in turn creates a pressure drop or vacuum at the opening 42 in the cover of the crusher housing 20, so that air is drawn from the interior of housing 20 through the exhaust duct 54, the porous filter bag 75, and then through the carbon pack 78 before being discharged through the opening 63 in the bottom of the fan housing 61. When lamps are inserted through the tube guide 46, they pass at their lower ends through the opening 42 and into the path of the rotating flails 36, at which point they are crushed into fine glass particles, the larger of which drop downwardly by gravity through the funnel section 21 into the bucket 23. The gases, mercury vapors and granulated glass particles, which are small enough to pass through the screen 53 in the outlet pipe 52, are conveyed in the exhaust air stream through the exhaust duct 54 and into the filter bag 75. Although the walls of the cartridge casing 71 are impervious to the passage therethrough of gas or mercury vapors, the latter can pass through the porous filter bag 75, and therefore are drawn downwardly through the activated carbon pack 78, which is especially designed to remove mercury vapors from the exhaust before it is discharged from the bottom of fan housing 61.

By way of example, it has been found that a particularly suitable activated carbon for use in manufacutring the filter element 78 is sold by North American Carbon, Inc. of Columbus, Ohio under the designation type GX137. This material is impregnated with carbon tetrachloride, and is extremely effective in removing mercury vapor from the exhaust air drawn from the crusher housing 20. Other forms of activated charcoal or carbon particles can also be employed, for example those of the idione coated variety, provided they are capable of reducing the mercury content in the exhaust air to a level not exceeding approximately 0.05 $mg/m^3$, which is the Threshold Limit Value (TLV), or maximum atmospheric concentration of mercury for a normal eight hour work day schedule recommended by the National Industrial Pollution Control Council. Prior to 1972 this TLV had been set as high as 0.1 $mg/m^3$ by the American Conference of Governmental Hygientists. Since it has been determined that at least some of the forty inch fluorescent lamps heretofore manufactured have contained upwards of 50 mg of mercury, it can be seen that the recommended TLV could soon be exceeded during continuous operation of a crusher of the type described, unless some provision is made for removing or filtering out the toxic mercury vapors during its operation.

Tests on the herein disclosed lamp crusher have indicated that unlike prior crushers, it can be operated without ever exceeding the recommended TLV, provided its carbon pack 78 is operating effectively. This was determined by monitoring the mercury vapor content of the air discharged from the fan housing 61, as well as the air in the vicinities of housing 20 and the inlet of the tube guide 46. With the unit properly operating it was discovered that the mercury vapor content in these areas was far less than the recommended TLV, and in most instances did not exceed 0.01 mg. of mercury per cubic meter. These results compared very favorably with those conducted on prior, conventional units which employed only a filter bag, and which did not use the special filter cartridge 70 and the associated vacuum fan 64. The tests on these so-called conventional units resulted in mercury vapor contents which far exceeded the above-noted TLV.

After prolonged use the filter element 78 tends to become saturated with the mercury residue removed from the crusher exhaust air, and as a consequence must be replaced or replenished. One way to determine when a replacement is necessary is to measure the mercury vapor content of the air discharged from the bottom of the fan housing 61. One type of instrument available for making this measurement is an ultraviolet photometer, which is distributed by Bacharach Instrument Co. of Pittsburgh, Pa. under the designation "Model MV-2 Mercury Vapor Sniffer". Instead of using this instrument continuously to monitor the effluent from housing 61, it would be possible empirically to determine the number of fluorescent lamps which could be crushed before a respective filter element 78 becomes saturated and needs replacement. A counter on or in association with the apparatus could then be employed to count the number of lamps destroyed by the crusher. The operator would then replace or replenish the element 78 each time a predetermined number of lamps have been crushed.

Instead of replacing the element 78 it may be desirable to supplement it when it appears to have reached or approached its limit. For this purpose FIG. 4, wherein like numerals are employed to denote elements similar to those employed in the first embodiment, illustrates a special piggy-back-type of activated carbon filter element 88, which can be interposed between the bottom of the cartridge casing 71 and the top of the fan housing 61. Element 88 contains the usual activated carbon or charcoal, which is housed between a pair of spaced screen elements 89. Element 88 has a reduced-diameter upper end 91, which is disposed to seat in the recess in the lower end of cartridge casing 71, and has in its lower end a recess 92 which enables the lower end of the element to be slid sealingly over the top of housing 61, thus positioning the two elements 78 and 88 between the fan housing and the filter bag 75.

It will be understood, of course, that in the case of either of the above-described embodiments the cartridge 70 is adapted to be gripped manually and shifted vertically on the discharge end 54' of the exhaust to enable the lower end of the cartridge to be inserted over, or to be removed from, the top of the fan housing 61.

From the foregoing it will be apparent that the present invention provides a relatively simple and inexpensive means for removing toxic mercury vapors from the exhaust air or gas discharged from a lamp crusher housing of the type disclosed herein. By employing the exhaust fan 64 a vacuum is generated at the exhaust opening 42 in the housing 20 so that all of the fine glass particles and gases generated within the housing will be discharged through the exhaust pipe or duct 54 and into the filter bag 75. Prior to applicant's invention the filter bags which were employed to collect particles discharged at the upper end of the crusher housing tended first to expand, when loaded during a crushing operation, and then to contract as soon as the actual crushing of the lamp ceased. Such bags functioned almost as bellows to pump hazardous gas particles back into housing 20, and upwardly through the feed tube 46 into the face of the operator. With the improved design disclosed herein, however, no such undesirable backup occurs. On the contrary, all particles and gases which enter the exhaust 54 are retained as particles in the bag 75, or pass as gases through the activated charcoal element 78, at which time objectionable mercury vapors and other gases are absorbed by the carbon pack before the exhaust air is discharged from the bottom of the fan housing 61.

Figure 4:
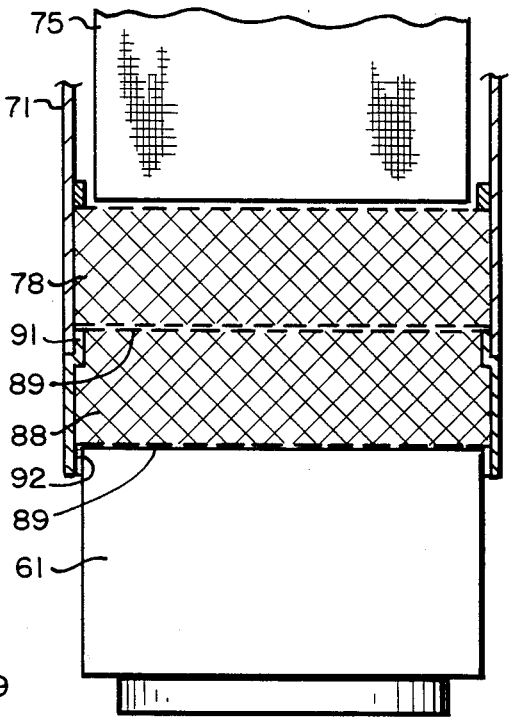
FIG. 4 is a view generally similar to FIG. 3 but showing a modified type of filter unit adapted to be employed with this invention.

When the bag 75 becomes filled or the carbon pack 78 requires replenishment, the entire cartridge 70 can be removed from the supporting bracket 56 and replaced, or if desired, the piggy-back back type charcoal pack 88 can be positioned in the lower end of the cartridge, which can then be reinserted over the top of fan housing 61 as shown in FIG. 4.

Figure 2:
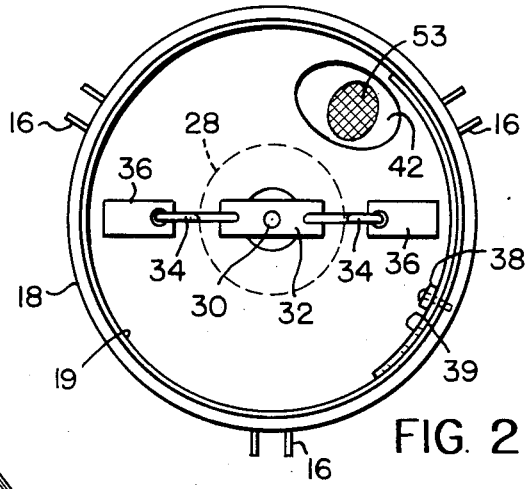
FIG. 2 is a fragmentary sectional view taken generally along the line 2—2 in FIG. 1 looking in the direction of the arrows.

If the protective plate 39 becomes unduly worn as a result of being struck by crushed lamp fragments, it can be adjusted angularly about the axis of housing 20 from its position as shown in FIG. 2, merely by inserting the bracket 38 into a different pair of the several pairs of mounting holes that are formed in the plate. Likewise, if for some reason the flails 36 become unduly worn, they can be readily replaced by disconnecting the cone 21 from wall 18, removing the worn flails, and hooking new flails onto opposite ends of plate 32. Also, it will be readily apparent that the plastic bucket 23 and the surrounding plastic bag 24 can also be replaced, whenever necessary.

While only certain embodiments of the invention have been illustrated and described in detail herein, it will be apparent that this invention is capable of still further modification, and that this application is intended to cover any such modifications as may fall within the scope of one skilled in the art, or the appended claims.

What I claim is:

1. In a fluorescent lamp crusher of the type including a housing having an inlet for admitting fluorescent lamps into the housing, and an outlet for allowing crushed lamp particles to drop into a waste collector beneath the housing, and a plurality of crusher members mounted to rotate in said housing adjacent said inlet to strike and crush the lamps entering the housing through said inlet, apparatus for preventing broken glass particles and gas from being blown back out of said inlet during operation of said crusher, the improvement comprising a filter cartridge, means for releasably connecting said cartridge to an exhaust opening formed in said housing to open on the interior thereof adjacent said inlet in said housing, vacuum means connected to said cartridge and said exhaust opening, and operable to draw exhaust air from within said housing successively through said exhaust opening and said filter cartridge, and means in said cartridge for removing toxic gas from the exhaust air passing through the cartridge.

2. Apparatus as defined in claim 1, wherein the last-named means comprises an activated charcoal filter element for removing mercury vapors from said exhaust air.

3. Apparatus as defined in claim 2, wherein said cartridge includes a second, porous filter element mounted in the cartridge adjacent said charcoal filter element, and said second filter element is operatively interposed between said exhaust opening in the housing and said charcoal filter element whereby said exhaust air is caused to pass successively through said second and said charcoal filter elements, respectively.

4. Apparatus as defined in claim 3, wherein said connecting means comprises an exhaust duct connected at one end to said exhaust opening, said cartridge comprises a gas impervious casing releasably secured at one end to the opposite end of said exhaust duct, said second filter element comprises a porous bag mounted in said casing and having an open end releasably and sealingly connected to said opposite end of said exhaust duct, and said charcoal filter element is mounted over an opening in the opposite end of said casing adjacent a closed end of said bag.

5. Apparatus as defined in claim 4, wherein said vacuum means comprises an exhaust fan supported on the exterior of said housing with its inlet in communication with the opening in said opposite end of said casing.

6. Apparatus as defined in claim 1, wherein said means for connecting said cartridge said exhaust opening, comprises an exhaust duct connected at one end to the exhaust opening in said housing, a cartridge support fixed relative to said housing at the exterior thereof, and spaced from the opposite end of said exhaust duct, and means for releasably mounting said cartridge on said support, including means for releasably attaching one end of said cartridge to said opposite end of said exhaust duct.

7. Apparatus as defined in claim 6, wherein said vacuum means comprises an exhaust fan mounted on said cartridge support adjacent the opposite end of said cartridge, and having an air inlet communicating through an opening in said support with the interior of said cartridge.

8. Apparatus as defined in claim 7, wherein said cartridge contains a plurality of porous filter elements at least one of which has been designed to remove mercury vapors from the exhaust air passing through said cartridge.

9. In a fluorescent lamp crusher having a housing enclosing a crusher for crushing lamps, and an exhaust fan for drawing exhaust air from said housing through an exhaust duct which communicates with the interior of said housing, a filter cartridge removably mounted between the outlet of said exhaust duct and the inlet to said fan, and the improvement comprising a gas impervious casing having an inlet in one end threof and an outlet in its opposite end, a porous filter bag positioned in said casing and having an open end secured to said one end of said casing around the inlet thereof, means on said casing for releasably securing said inlet end thereof to the outlet of said exhaust duct, with said duct communicating with the interior of said filter bag, and with said outlet end of said casing releasably positioned over the inlet to said fan, and an activated charcoal filter element secured in said casing adjacent said opposite end thereof to overlie the outlet in said casing, said filter element including means for removing mercury vapors from the exhaust air drawn through said cartridge, said means for securing said inlet on said casing to said exhaust duct outlet and comprising a resileint washer secured between said bag and said one end of said casing and having a central opening smaller than, and registering with the centers of, said casing inlet and the opened end of said bag and adapted to surround the outlet end of said duct.

10. Apparatus as defined in claim 9, wherein said charcoal filter element is spaced slightly inwardly from said opposite end of said casing to permit insertion of the latter over said exhaust fan inlet, and the cross sectional area of said filter bag is smaller than the cross sectional area of said casing thereby to leave a small space between said bag and said casing.

11. Apparatus as defined in claim 10, including a further charcoal filter element releasably mounted in said opposite end of said casing adjacent the first-named charcoal filter element.

* * * * *